US011744386B2

(12) United States Patent
Hoffman

(10) Patent No.: US 11,744,386 B2
(45) Date of Patent: Sep. 5, 2023

(54) HEAD AND LIMB SAFETY CRIB BUMPER SYSTEM

(71) Applicant: Britton Hoffman, Beach Haven, NJ (US)

(72) Inventor: Britton Hoffman, Beach Haven, NJ (US)

( * ) Notice: Subject to any disclaimer, the term of this patent is extended or adjusted under 35 U.S.C. 154(b) by 0 days.

(21) Appl. No.: 17/830,953

(22) Filed: Jun. 2, 2022

(65) Prior Publication Data

US 2023/0039215 A1 Feb. 9, 2023

Related U.S. Application Data

(60) Provisional application No. 63/230,394, filed on Aug. 6, 2021.

(51) Int. Cl.
*A47D 15/00* (2006.01)

(52) U.S. Cl.
CPC ..... *A47D 15/008* (2013.01)

(58) Field of Classification Search
None
See application file for complete search history.

(56) References Cited

U.S. PATENT DOCUMENTS

| | | | | |
|---|---|---|---|---|
| 5,437,071 | A * | 8/1995 | Feigenbaum | A47D 15/008 5/663 |
| 6,772,457 | B1 * | 8/2004 | Alaback | A47D 15/008 5/663 |
| 8,281,432 | B2 * | 10/2012 | Finell | A47D 15/008 5/663 |
| 9,095,226 | B1 * | 8/2015 | Noorani | A47D 15/00 |
| 2013/0097784 | A1 * | 4/2013 | Kaplan | A47D 15/00 5/663 |
| 2019/0261791 | A1 * | 8/2019 | Marton | A47D 13/06 |

* cited by examiner

*Primary Examiner* — Justin C Mikowski
*Assistant Examiner* — Adam C Ortiz
(74) *Attorney, Agent, or Firm* — Brennan, Manna & Diamond, LLC

(57) ABSTRACT

The present invention relates to a novel crib bumper device which creates a safe and soft environment for an infant sleeping in a crib. The device is configured to fit snugly between the vertical slats of a crib. Specifically, the device comprises a foam component of adjustable length, with a flat back surface and an inside portion comprising elongated, mushroom-shaped columns sized to fit between the vertical slats of a crib. The flat outside surface is then secured around the perimeter of a crib via a hook and loop fastener strap.

17 Claims, 6 Drawing Sheets

HEAD AND LIMB SAFETY CRIB BUMPER SYSTEM

CROSS-REFERENCE TO RELATED APPLICATION

The present application claims priority to, and the benefit of, U.S. Provisional Application No. 63/230,394, which was filed on Aug. 6, 2021 and is incorporated herein by reference in its entirety.

FIELD OF THE INVENTION

The present invention relates generally to the field of crib bumper devices. More specifically, the present invention relates to an improved crib bumper device that provides users with an improved barrier system for cribs. Specifically, the device comprises a plurality of foam bumpers, with the inside of the bumpers pushed into the vertical slats of the crib and the outside of the bumpers secured to the crib via a hook and loop fastener strap. Accordingly, the present disclosure makes specific reference thereto. Nonetheless, it is to be appreciated that aspects of the present invention are also equally applicable to other like applications, devices and methods of manufacture.

BACKGROUND

By way of background, conventional crib bumpers are used to increase bodily protection and to provide additional comfort and support to children within cribs. Typically, conventional bumper pads are a cushioned material that encompasses the entire inside perimeter of a crib and are used by parents and guardians to protect their child from injury in case the child would fall against the hard, wooden rails or slats, as the sides and edges of a crib are often constructed using hard, durable wood or plastic materials. A crib bumper serves to protect a baby from bumping and/or laying his or her head against the hard rails of a crib. A bumper also provides an aesthetically pleasing and soft surrounding for a newborn baby.

Furthermore, conventional crib bumpers provide resilient cushioning material adjacent the crib walls to prevent a baby or infant from hitting his or her head on the hard crib walls during sleep, causing the infant to wake due to the discomfort and possible injury. Crib bumpers also help prevent an infant's arms or legs from poking out between the spaced slats and getting stuck, causing injuries. A typical crib bumper utilizes ties for securing the panels to the slats or corner posts of the crib. This can cause infants to become entangled with the ties and/or bumper while sleeping, causing injuries. Further, some conventional bumpers have been banned by pediatricians due to suffocation hazards, as the bumper encompasses the entire inside perimeter of a crib preventing air from passing through.

Therefore, a novel crib bumper device is needed that can fit between the side rails of a crib to prevent an infant from hitting his or her head on the hard crib walls during sleep, and to prevent an infant's arms or legs from poking out between the spaced slats and getting stuck. Further, a useful device is needed that provides users with an improved barrier for cribs that allows air to pass through and that enables users to have peace of mind that their children are safe, secure, and comfortable while sleeping inside a crib.

Therefore, there exists a long-felt need in the art for a crib bumper device that provides bumpers that are designed to fit between the vertical rails of a crib. There is also a long-felt need in the art for a crib bumper device that is configured around a crib perimeter and secured via a hook and loop fastener strap. Further, there is a long-felt need in the art for a crib bumper device that ensures the bumpers fit between the vertical rails on the crib, preventing an infant from getting their limbs stuck between the rails. Moreover, there is a long-felt need in the art for a device that cushions an infant from bumping into the hard edges of a crib while sleeping. Further, there is a long-felt need in the art for a crib bumper device that offers a way to improve the overall sleep quality for infants within a crib. Finally, there is a long-felt need in the art for a crib bumper device that provides infants with a comfortable means of sleeping within a crib, without risk of suffocation.

The subject matter disclosed and claimed herein, in one embodiment thereof, comprises a crib bumper device. The device is designed to keep infants safe and comfortable while in a crib. Specifically, the crib bumper device is configured to fit snugly between the vertical slats of a crib. The device comprises a foam component of adjustable length, with a flat back surface and an inside portion comprising elongated, mushroom-shaped columns sized to fit between the vertical slats of a crib. The flat outside surface is then secured around a perimeter of a crib via a hook and loop fastener strap.

In this manner, the crib bumper device of the present invention accomplishes all of the forgoing objectives and provides users with a device that creates a safe and soft environment for an infant sleeping in a crib. The device is dimensioned to fit snugly between the vertical slats of a crib. The device prevents an infant from getting their limbs stuck in the crib rails and cushions the infant from bumping into the crib's edges.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a crib bumper device. The device creates a safe and soft environment for an infant sleeping in a crib. Specifically, the crib bumper device is dimensioned to fit snugly between the vertical slats of a crib. The device comprises a foam component of adjustable length, with a flat back surface and an inside portion comprising elongated, mushroom-shaped columns sized to fit between the vertical slats of a crib. The flat outside surface is then secured around a perimeter of a crib via a hook and loop fastener strap. Accordingly, utilizing the herein embodiments of the crib bumper device prevents an infant from getting their limbs stuck in the crib rails and cushions the infant from bumping into the crib's edges.

In another embodiment, the crib bumper device comprises a long, cushioned, two-sided, rectangular shaped soft protective material that fits securely between each individual crib slat. The material typically comprises a particular density of foam, or foam-like material, or any other suitable material as is known in the art, including but not limited to, open cell polyurethane foam with a thickness of ~⅜", a closed cell polyethylene foam with a thickness of ~¾", a 100% natural latex foam, a chemical free foam, or a fire-resistant foam. Thus, the device provides a soft surface for the infant's head and body and prevents any part of the hard crib rail, edge, and/or slats from coming into contact with the infant. Accordingly, the device can be easily inserted between the crib slats and secured and is simple to remove for cleaning. Specifically, once removed, the device can be wiped down with a damp cloth and/or child-safe disinfectant.

In another embodiment, the inside portion of the device, comprising elongated, mushroom-shaped or arrow-shaped columns sized to fit between the vertical slats of a crib, does not allow an infant to climb on it and/or use it as leverage to push his or her body over the crib due to its unique shape and the fact that once inserted, very little material protrudes through the slats and into the crib for the child to stand on. Additionally, if a child presses on the mushroom-shaped columns or rolls into them, the mushroom-shaped columns will not be pushed out by the child. The shape of the columns provides additional surface area near the top of the mushroom shape, that once forced through the recesses between the crib slats, expand requiring additional force to remove the columns.

In another embodiment, the device allows air to circulate between the crib slats and through the material of the device. Specifically, the elongated mushroom-shaped columns do not wrap all the way around the crib slats, creating channels which allow air to enter and reduce the possibility of suffocation and any unnecessary risk of SIDs.

In another embodiment, the crib bumper device comprises an outer fabric sleeve or covering over the foam bumper. The outer fabric sleeve or covering is manufactured from knitted, removable and washable soft fabrics that are comforting and aesthetically pleasing and can easily be removed for individual washing, such as but not limited to, a polypropylene non-woven material, which has inherent water repellant properties, which can protect and extend the useful life of the foam bumper while retaining washability, as well as fabrics comprising natural fibers, synthetic fibers and blends thereof, and fire-resistant materials. The fabric covering is typically secured via a zipper, but any suitable securing means as is known in the art can be used to secure the covering, such as buttons, snaps, Velcro, ties, etc. Thus, the device can easily be applied and is simple to remove for washing.

Further, due to its sleek design and independence of any ties to secure it, the crib bumper device does not hinder the removal of the crib sheet or the movement of the crib when retrieving the baby. The lack of ties also makes it less dangerous and less cumbersome in its overall use and does not risk the child becoming entangled with the ties. The preferred embodiment of the present invention also allows the baby to see through the crib rails.

In another embodiment, the mushroom-shaped columns and/or the flat, outside area of the crib bumper device comprises a plurality of indicia, designs, patterns, and/or other aesthetics.

The crib bumper device can be manufactured in a variety of shapes and styles, as there are many different sizes, shapes, and styles of cribs available. Full use and practicality of this invention depends on its flexible, yet precise, measurements and size. Unlike previous art, the invention fits all types of crib rails.

In yet another embodiment, a method of providing an improved barrier system for protecting infants sleeping within a crib is described. The method includes the steps of inserting a foam component into the fabric covering. After the foam component is inserted into the fabric covering, the method continues with closing the fastening means to keep the foam component in place. Such a design allows the foam component to be removed for cleaning or replacement and allows the fabric covering to be more easily machine-washed. After the fabric covering is in place, the method continues with positioning the fabric covering and the foam component along an outside perimeter of a crib, with the plurality of mushroom-shaped columns facing the slats of the crib. Further, the method continues by pushing the plurality of mushroom-shaped columns between the crib slats, securing the fabric covering and the foam component. Finally, once in the desired position, the method provides for securing the flat outside portion of the foam component via a fastener strap with a hook and loop securing means.

In yet another embodiment of the present invention, crib bumper device is disclosed for keeping infants safe and comfortable while in a crib. The device is comprised of a foam bumper system that wraps around the crib perimeter. The device has a flat back surface which would face outward from the crib base, with the inside portion comprising a plurality of elongated, mushroom-shaped columns spaced approximately two inches apart. The device is then positioned in a removable, washable outer fabric covering. The device is then installed by pushing the plurality of elongated, mushroom-shaped columns between the vertical slats of the crib. The flat back surface is then secured via a strap with a hook and loop securing means. The crib bumper device thus provides a safe and soft environment for an infant sleeping in a crib.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
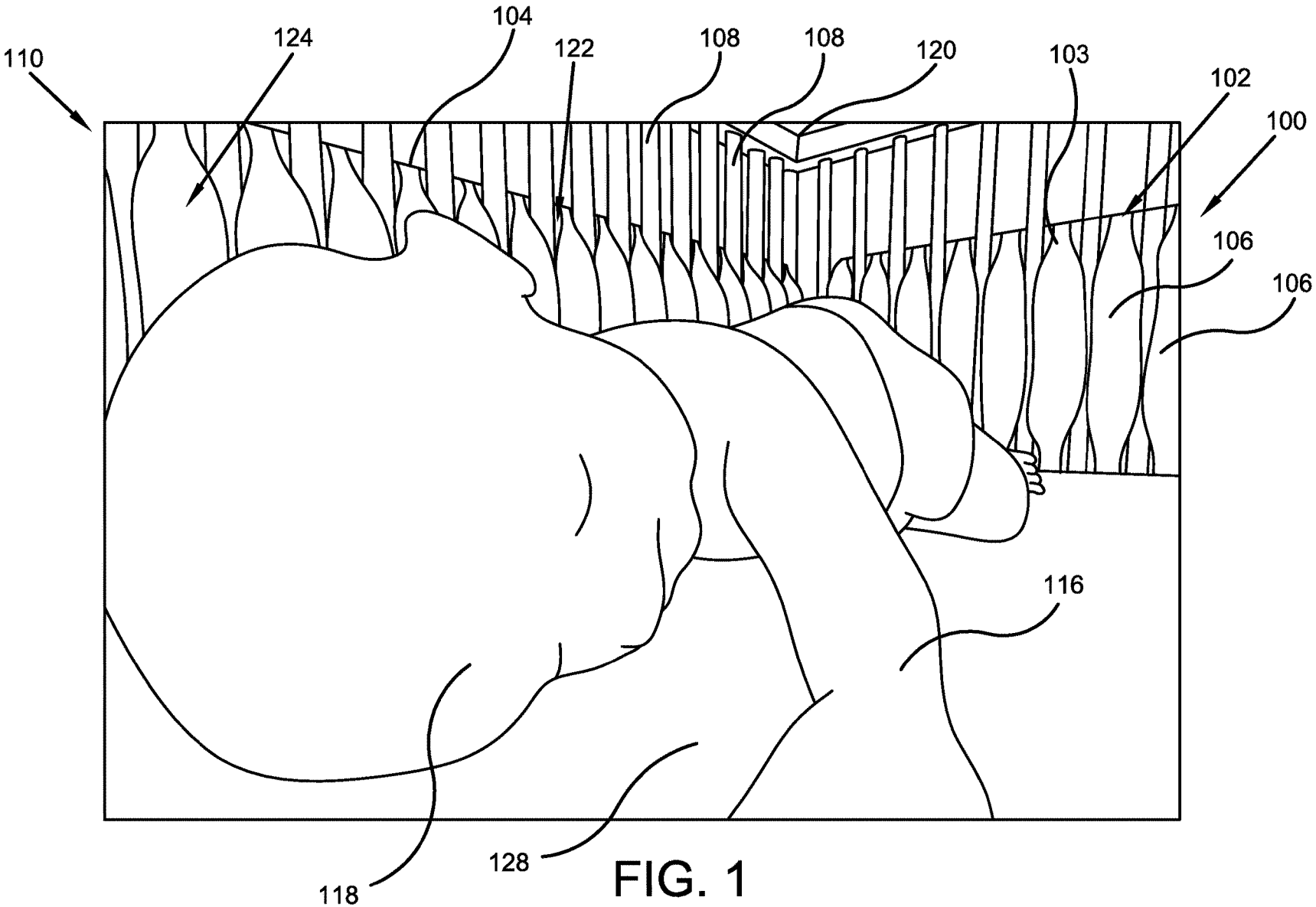
FIG. 1 illustrates a perspective view of one embodiment of the crib bumper device of the present invention in use in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a crib bumper device that provides bumpers that are designed to fit between the vertical rails of a crib. There is also a long-felt need in the art for a crib bumper device that is configured around a crib perimeter and secured via a hook and loop fastener strap. Further, there is a long-felt need in the art for a crib bumper device that ensures the bumpers fit between the vertical rails on the crib, preventing an infant from getting their limbs stuck between the rails. Moreover, there is a long-felt need in the art for a device that cushions an infant from bumping in the hard edges of a crib while sleeping. Further, there is a long-felt need in the art for a crib bumper device that offers a way to improve the overall sleep quality for infants within a crib. Finally, there is a long-felt need in the art for a crib bumper device that provides infants with a comfortable means of sleeping within a crib, without risk of suffocation.

The present invention, in one exemplary embodiment, is a novel crib bumper device for keeping infants safe and comfortable while in a crib. The device is comprised of a foam bumper system that wraps around the crib perimeter. The device has a flat back surface which would face outward from the crib base, with the inside portion comprising a plurality of elongated, mushroom-shaped columns spaced approximately two inches apart. The present invention also includes a novel method of providing an improved barrier system for protecting infants sleeping within a crib. The method includes the steps of inserting a foam bumper into the fabric covering. After the fabric covering is in place, the method continues with positioning the device along an outside perimeter of a crib, with the plurality of mushroom-shaped columns facing the slats of the crib. Further, the method continues by pushing the plurality of mushroom-shaped columns between the crib slats, securing the device. Finally, once in the desired position, the method provides for securing the flat outside portion of the device via a fastener strap with a hook and loop securing means.

Referring initially to the drawings, FIG. 1 illustrates a perspective view of one embodiment of the crib bumper device 100 of the present invention. In the present embodiment, the crib bumper device 100 is an improved crib bumper device for keeping infants safe and comfortable while in a crib. More specifically, the crib bumper device 100 is dimensioned to fit snugly between the vertical slats of a crib. The device 100 comprises a foam component 102 of adjustable length, with a flat back surface 104 and an inside portion 103 comprising a plurality of elongated, mushroom-shaped columns 106 sized to fit between the vertical slats 108 of a crib 110. The flat outside surface 104 is then secured around a perimeter of a crib 110 via a fastener strap 112 with a hook and loop securing means 114. Accordingly, utilizing the herein embodiments of the crib bumper device 100 prevents an infant 118 from getting their limbs 116 stuck in the crib rails or slats 108 and cushions the infant 118 from bumping into the crib's edges 120.

FIG. 1 illustrates a first embodiment of the crib bumper device 100 that comprises a foam component 102. The foam component 102 is dimensioned to encompass a large variety of crib rails or slats 108. In a preferred embodiment, the foam component 102 is approximately 52 inches in length and between approximately 8-12 inches in height, depending on the material chosen. Alternatively, the foam component 102 could be approximately 30-32 inches in length to accommodate specific crib dimensions.

In another embodiment, the crib bumper device 100 comprises a long, cushioned, two-sided, rectangular shaped foam protective component 102 that fits securely between each individual crib slat 108. The foam component 102 is typically manufactured of a particular density of foam, or foam-like material, or any other suitable material as is known in the art, including but not limited to, open cell polyurethane foam with a thickness of ~⅜", a closed cell polyethylene foam with a thickness of ~¾", a 100% natural latex foam, a chemical free foam, or a fire-resistant foam. Thus, the device 100 provides a soft surface for the infant's head and body and prevents any part of the hard crib rail, edge, and/or slats 108 from coming into contact with the infant 118. Accordingly, the device 100 can be easily inserted between the crib slats 108 and secured and is simple to remove for cleaning. Specifically, once removed, the device 100 can be wiped down with a damp cloth and/or child-safe disinfectant.

Furthermore, the inside portion 103 of the device 100, comprising a plurality of elongated, mushroom-shaped columns 106 sized to fit between the vertical slats 108 of a crib 110, does not allow an infant 118 to climb on it and/or use it as leverage to push his or her body over the crib 110 due to its unique shape and the fact that once inserted, very little material protrudes through the slats 108 and into the crib 110 for the child 118 to stand on. Additionally, if a child 118 presses on the plurality of mushroom-shaped columns 106 or rolls into them, the plurality of mushroom-shaped columns 106 will not be pushed out by the child 118. The shape of the columns 106 provides additional surface area that must be forced through the recesses between the crib slats 108, and once through, it expands requiring additional force to remove the columns 106.

In another embodiment, the device 100 allows air to circulate between the crib slats 108 and through the material of the device 100. Specifically, the plurality of elongated mushroom-shaped columns 106 do not wrap all the way around the crib slats 108, creating channels 122 which allow air to enter and reduce the possibility of suffocation and any unnecessary risk of SIDs.

In another embodiment, the crib bumper device 100 comprises an outer fabric sleeve 124 or covering over the foam component 102. The outer fabric sleeve 124 or covering is manufactured from knitted, removable and washable soft fabrics that are comforting and aesthetically pleasing and can easily be removed for individual washing, such as but not limited to, a polypropylene non-woven material, which has inherent water repellant properties, which can protect and extend the useful life of the foam component 102 while retaining washability, as well as fabrics comprising natural fibers, synthetic fibers and blends thereof, and fire-resistant materials. The outer fabric covering 124 is typically secured via a zipper 126, but any suitable securing means as is known in the art can be used to secure the covering, such as buttons, snaps, Velcro, ties, etc. Thus, the device 100 can easily be applied and is simple to remove for washing when needed.

Further, due to its sleek design and independence of any ties to secure it, the crib bumper device 100 does not hinder the removal of the crib sheet 128 or the movement of the crib 110 when retrieving the baby 118. The lack of ties also makes it less dangerous and less cumbersome in its overall use and does not risk the child 118 becoming entangled with the ties. The preferred embodiment of the present invention also allows the baby 118 to see through the crib slats 108.

Figure 2:
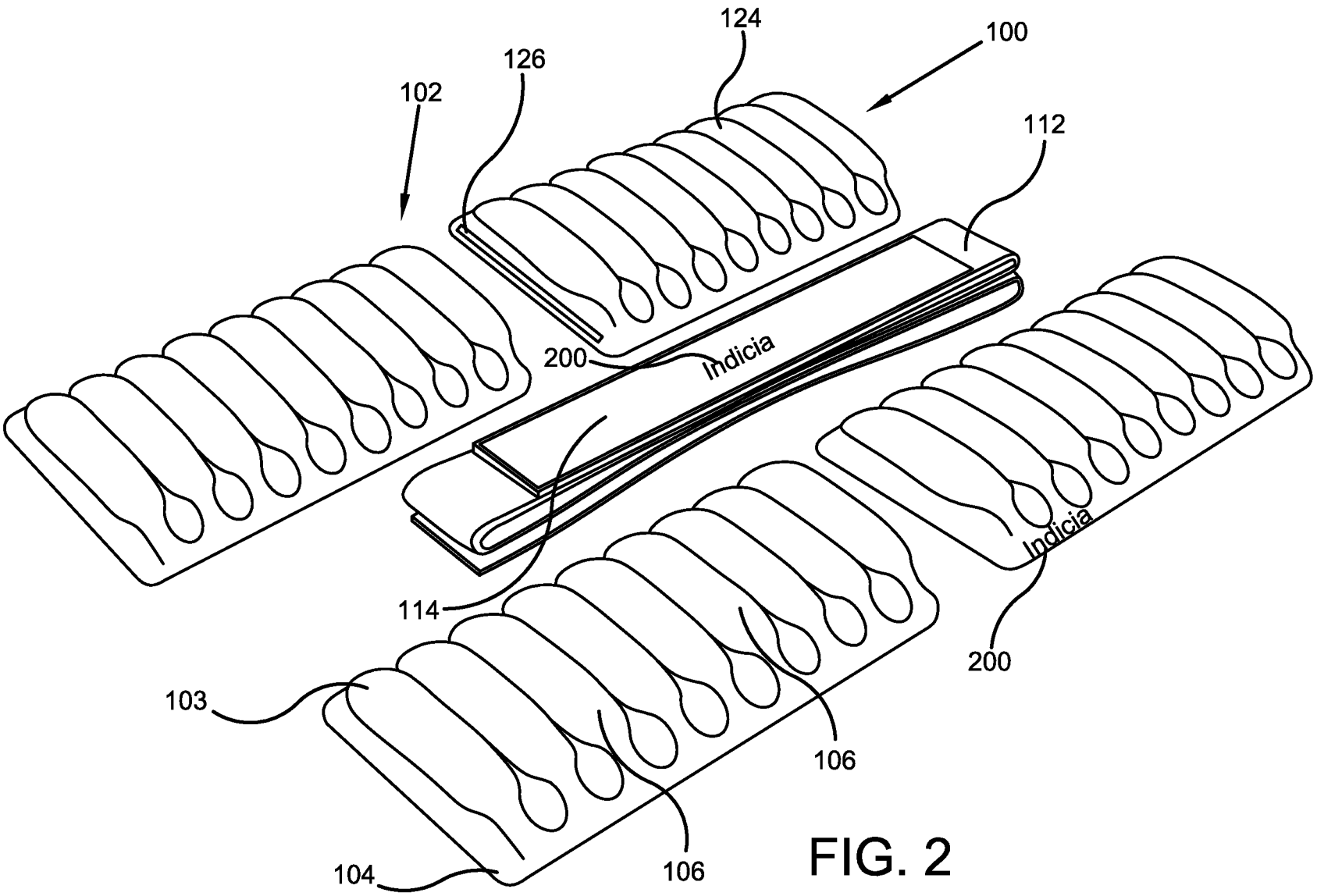
FIG. 2 illustrates a perspective view of another embodiment of the crib bumper device of the present invention unattached to a crib in accordance with the disclosed architecture.

FIG. 2 illustrates a perspective view of another embodiment of the crib bumper device 100 of the present invention. In this embodiment, a crib bumper device 100 is disclosed that is rectangular in shape with two sides. A flat, outer surface 104 is located on the first side and a plurality of elongated, mushroom-shaped columns 106 is located on the second side or inside portion 103.

Typically, the two sides are integral and formed as one piece. Additionally, in another embodiment, the two sides can be independent of each other and secured together via any suitable securing means as is known in the art, such as gluing. If independent, the two sides can be manufactured of different materials, depending on the needs and/or wants of a user. For example, the outer surface could be made of a fabric that matches the crib sheets 128 and/or other room décor to make the device 100 aesthetically pleasing.

In another embodiment, the plurality of mushroom-shaped columns 106 and/or the flat, back surface 104 of the crib bumper device 100 comprises a plurality of indicia 200, designs, patterns, and/or other aesthetics. Specifically, the device 100 can include advertising, a trademark, or other letters, designs, or characters, printed, painted, stamped, or integrated into the device 100, or any other indicia 200 as is known in the art. Specifically, any suitable 202 indicia as is known in the art can be included, such as but not limited to, patterns, logos, emblems, images, symbols, designs, letters, words, characters, animals, advertisements, brands, etc., that may or may not be child/brand related.

The crib bumper device 100 can be manufactured in a variety of shapes and styles, as there are many different sizes, shapes, and styles of cribs 110 available. Full use and practicality of this invention depends on its flexible, yet precise, measurements and size. Unlike previous art, the invention fits all types of crib slats 108.

Figure 3:
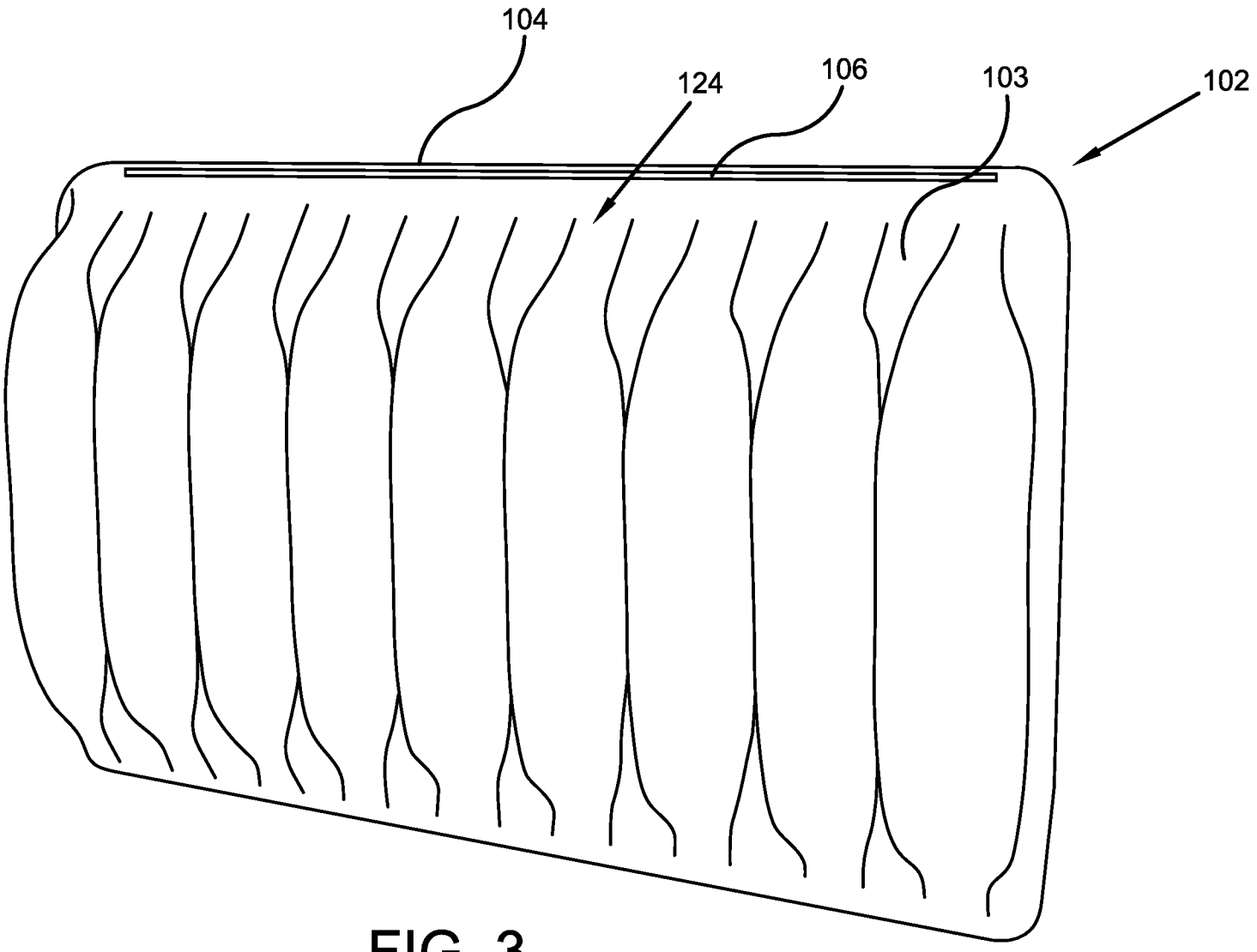
FIG. 3 illustrates a perspective view showing the foam bumpers of the crib bumper device in accordance with the disclosed architecture.

FIG. 3 illustrates a perspective view of another embodiment of the crib bumper device 100 of the present invention. The crib bumper device 100 shown in the drawings addresses the shortcomings of existing crib bumpers. The crib bumper device 100 comprises an outer covering 124 of fabric material. The outer covering 124 of fabric material can comprise a resiliently cushioning core of foam. The resultant device 100 can comprise one long continuous and uninterrupted strip for securing around the perimeter of a crib 110 or can comprise a string of four serially connected bumper devices 100, that when suitably positioned, extend along the four sides of a standard-sized crib mattress. Desirably, the device 100 should remain in a vertical orientation, and should remain fully extended to its full vertical height rather than collapsing or bunching and should remain closely adjacent to the walls of the crib 110 with the lower edge of the device 100 either resting atop the upper surface of the crib mattress or tucked between the outer edge of the mattress and the adjacent crib wall.

Figure 4:
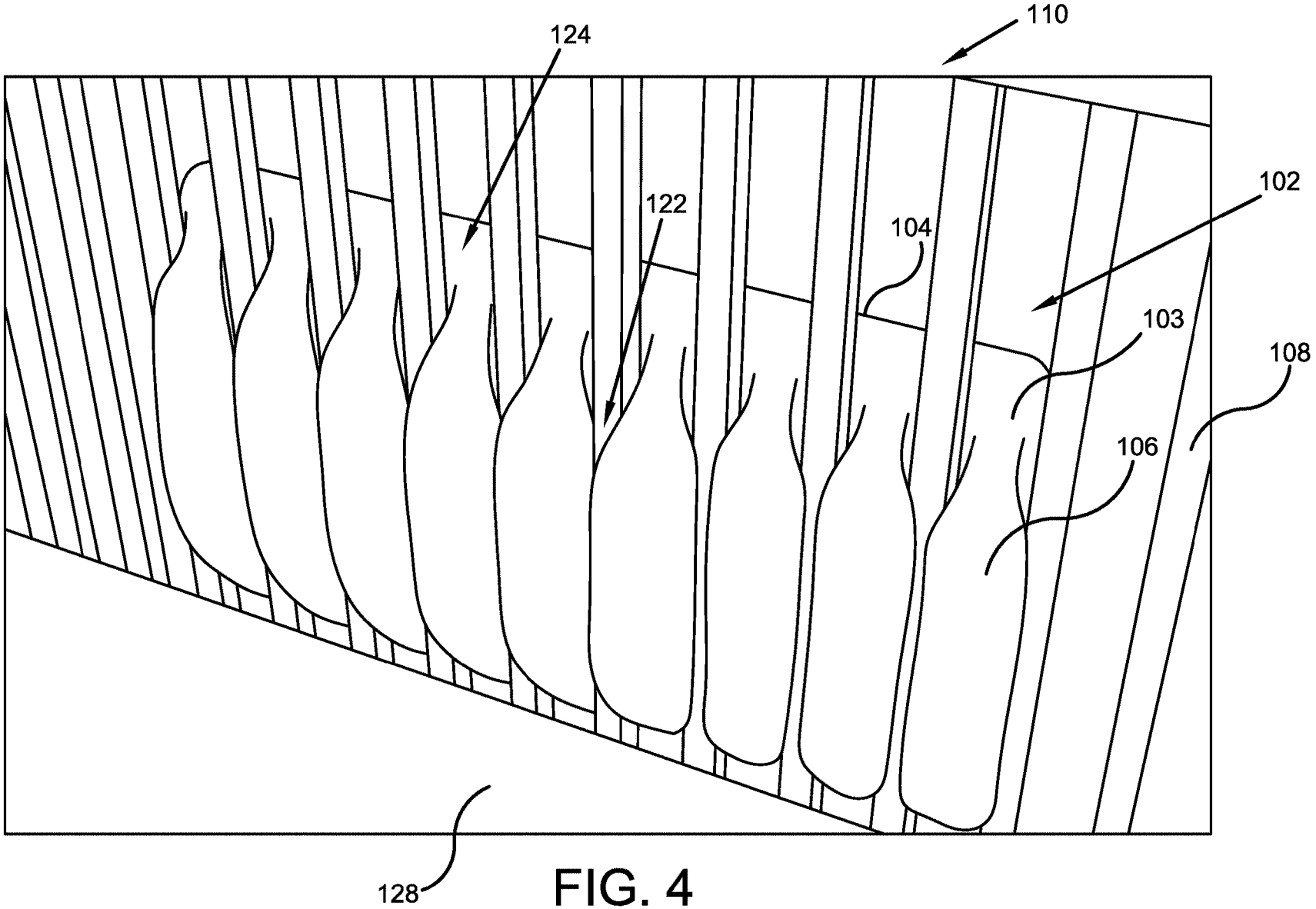
FIG. 4 illustrates a perspective view showing the foam bumpers of the crib bumper device secured to the vertical slats of a crib in accordance with the disclosed architecture.

FIG. 4 illustrates a perspective view of another embodiment of the crib bumper device 100 of the present invention. In use, the foam component 102 is inserted into the fabric covering 124. After the foam component 102 is inserted into the fabric covering 124, the fastening means 126 is closed to keep the foam component 102 in place. Such a design allows the foam component 102 to be removed for cleaning or replacement and allows the outer fabric covering 124 to be more easily machine-washed. After the outer fabric covering 124 is in place, the device 100 is positioned along an outside perimeter of a crib 110, with the plurality of mushroom-shaped columns 106 facing the slats 108 of the crib 110. The plurality of mushroom-shaped columns 106 are then pushed between the crib slats 108, securing the device 100. Once in the desired position, the flat outside portion 104 of the device 100 is secured via a fastener strap 112 with a hook and loop securing means 114.

Furthermore, by using materials, such as foam padding, fabric and zippers, as well as a structure lacking rigid support elements, the disclosed embodiments allow the crib bumper device 100 to compress to fit between the crib slats 108. In such a manner, a single size crib bumper device 100 can be used with slats 108 of various lengths and widths to provide a "one size fits all" solution for a majority of crib owners. A plurality of uniform-sized crib bumper devices 100 comprising a plurality of elongated, mushroom-shaped columns 106 spaced approximately two inches apart, can then be sold as a set for use with a large variety of cribs 110.

Figure 5:
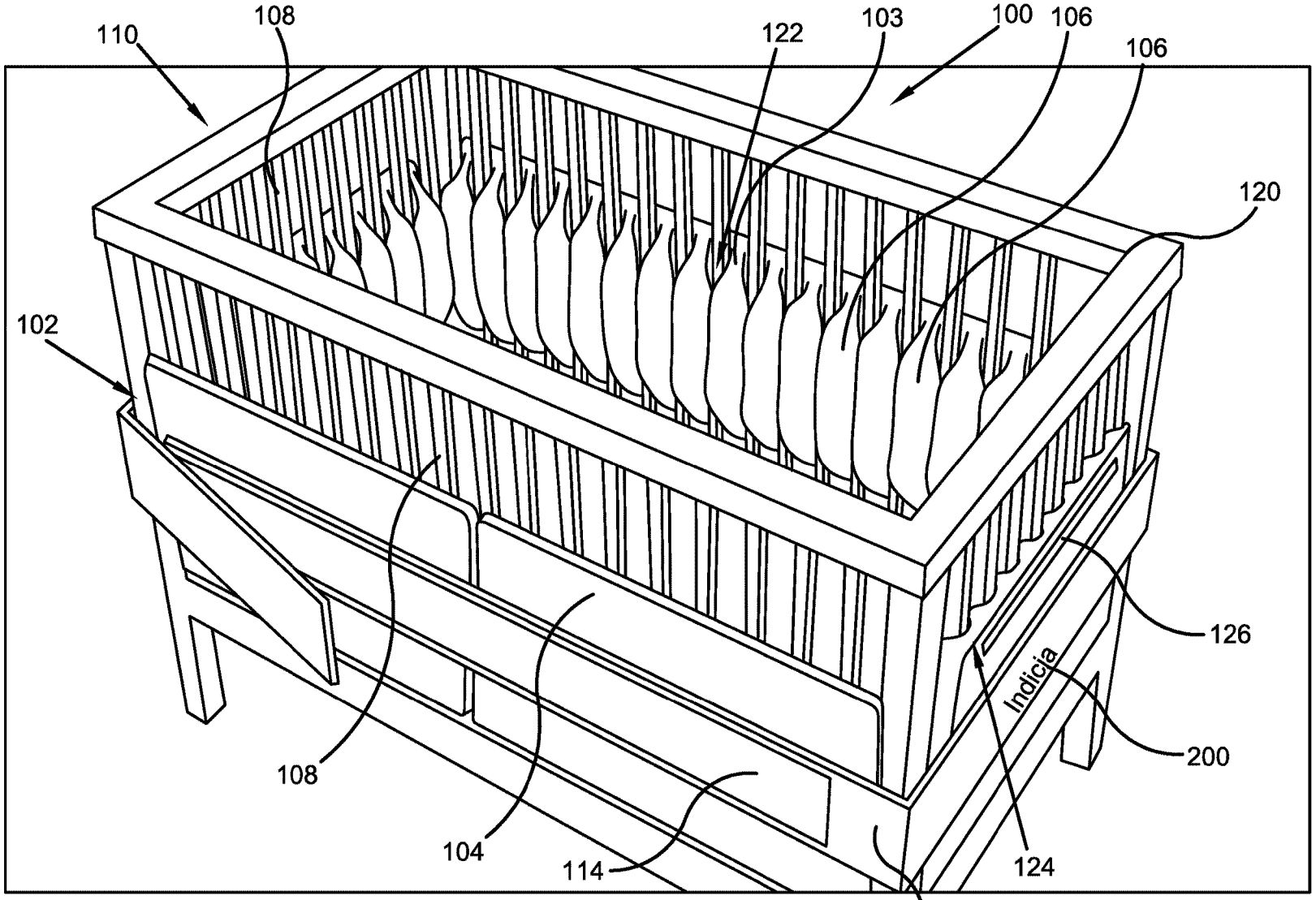
FIG. 5 illustrates a perspective view of one embodiment of the crib bumper device of the present invention secured around a perimeter of a crib in accordance with the disclosed architecture.

FIG. 5 illustrates a perspective view of another embodiment of the crib bumper device 100 of the present invention. The crib bumper device 100 is disclosed for keeping infants 118 safe and comfortable while in a crib 110. The device 100 is comprised of a foam component 102 that wraps around the crib perimeter. The device 100 has a flat back surface 104 which would face outward from the crib base, with the inside portion 103 comprising a plurality of elongated, mushroom-shaped columns 106 spaced approximately two inches apart. The device 100 is then positioned in a removable, washable outer fabric covering 124. The device 100 is then installed by pushing the plurality of elongated, mushroom-shaped columns 106 between the vertical slats 108 of the crib 110. The flat back surface 104 is then secured via a strap 112 with a hook and loop securing means 114. The crib bumper device 100 thus provides a safe and soft environment for an infant 118 sleeping in a crib 110.

Figure 6:
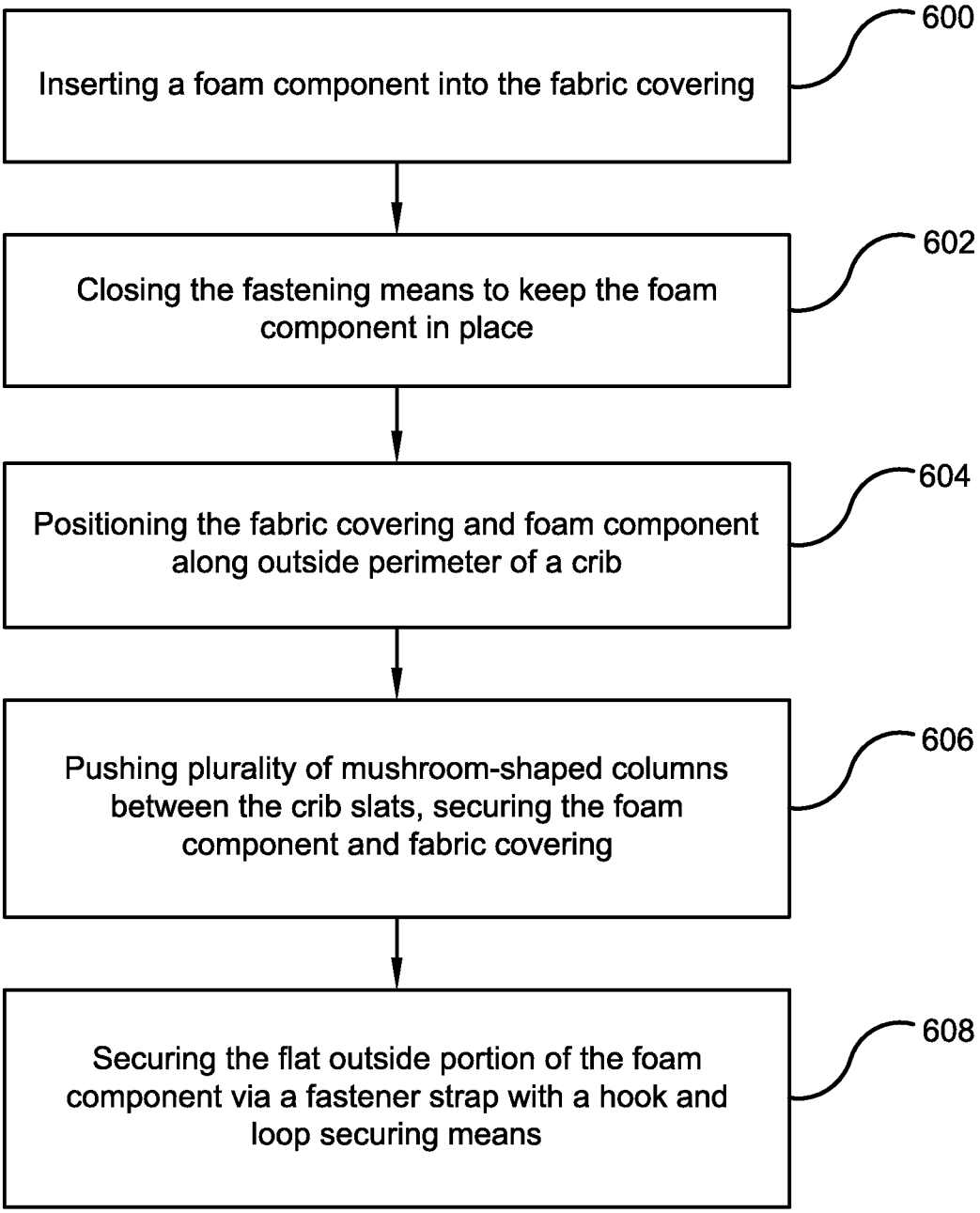
FIG. 6 illustrates a flowchart showing the method of providing an improved barrier system for protecting infants sleeping within a crib in accordance with the disclosed architecture.

FIG. 6 illustrates a flowchart of the method of providing an improved barrier system for protecting infants sleeping within a crib. The method includes the steps of at 600, inserting a foam component into the fabric covering. After the foam component is inserted into the fabric covering, the method continues with at 602, closing the fastening means to keep the foam component in place. Such a design allows the foam component to be removed for cleaning or replacement and allows the fabric covering to be more easily machine-washed. After the fabric covering is in place, the method continues with at 604, positioning the fabric covering and foam component along an outside perimeter of a crib, with the plurality of mushroom-shaped columns facing the slats of the crib. Further, the method continues at 606, by pushing the plurality of mushroom-shaped columns between the crib slats, securing the fabric covering and foam component. Finally, once in the desired position, the method provides for at 608, securing the flat outside portion of the foam component via a fastener strap with a hook and loop securing means.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "crib bumper device" and "device" are interchangeable and refer to the crib bumper device 100 of the present invention.

Notwithstanding the forgoing, the crib bumper device 100 of the present invention can be of any suitable size and configuration as is known in the art without affecting the overall concept of the invention, provided that it accomplishes the above-stated objectives. One of ordinary skill in the art will appreciate that the crib bumper device 100 as shown in FIGS. 1-6 is for illustrative purposes only, and that many other sizes and shapes of the crib bumper device 100 are well within the scope of the present disclosure. Although the dimensions of the crib bumper device 100 are important design parameters for user convenience, the crib bumper device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A crib bumper device for keeping an infant safe and comfortable while in a crib, the crib bumper device comprising: a foam component having a flat back surface and an inside portion, wherein the inside portion comprises a plurality of elongated, narrow-ended columns defining a height sized to fit between a plurality of vertical slats of the crib; the plurality of vertical slats defining a first surface that faces an interior of the crib; and a second surface that faces away from the interior of the crib; wherein once the plurality of elongated, narrow-ended columns are positioned between the plurality of vertical slats of the crib, the flat back surface is then secured around a perimeter of the crib along the second surface; wherein the plurality of elongated, narrow-ended columns, when inserted between the plurality of vertical slats of the crib along the defined height, do not wrap all the way around any of the plurality of the vertical slats of the crib, thereby creating a plurality of channels that allow air to enter an interior of the crib.

2. The crib bumper device of claim 1, wherein the flat back surface is secured around the perimeter of the crib via a fastener strap.

3. The crib bumper device of claim 2, wherein the fastener strap comprises a hook and loop securing means.

4. The crib bumper device of claim 3, wherein the foam component is approximately 52 inches in length and between 8 and 12 inches in height.

5. The crib bumper device of claim 3, wherein the foam component is between 30 and 32 inches in length.

6. The crib bumper device of claim 1 further comprising an outer fabric sleeve for covering the foam component.

7. The crib bumper device of claim 6, wherein the outer fabric sleeve is secured via a zipper.

8. The crib bumper device of claim 1, wherein the foam component is of unitary construction.

9. The crib bumper device of claim 1, wherein the flat back surface and the inside portion are independent components secured together.

10. The crib bumper device of claim 1, wherein each of the inside portion and the flat back surface comprise a plurality of indicia.

11. The crib bumper device of claim 1, wherein each of the plurality of elongated, narrow-ended columns are spaced approximately two inches apart.

12. A crib bumper device for keeping an infant safe and comfortable while in a crib, the crib bumper device comprising: a foam component having a flat back surface and an inside portion; wherein the inside portion comprises a plurality of elongated, narrow-ended columns defining a height sized to fit between a plurality of vertical slats of the crib; wherein once the plurality of elongated, narrow-ended columns are positioned between the plurality of vertical slats of the crib along the defined height, the flat back surface is then secured around a perimeter of the crib via a fastener strap having a hook and loop securing means; and further wherein the plurality of elongated, narrow-ended columns, when inserted between the plurality of vertical slats of the crib, do not wrap all the way around the plurality of vertical slats of the crib, thereby creating a plurality of channels that allow air to enter an interior portion of the crib.

13. The crib bumper device of claim 12 further comprising an outer fabric sleeve for covering the foam component.

14. The crib bumper device of claim 12, wherein each of the inside portion and the flat back surface comprise a plurality of indicia.

15. A method of providing an improved barrier system for protecting an infant sleeping within a crib according to claim 1, the method comprising the steps of; inserting the foam component into a fabric covering; closing a fastening means on the fabric covering to keep the foam component in place; positioning the fabric covering and the foam component along the perimeter of a crib; and securing the fabric covering and foam component around the perimeter of the crib.

16. The method of claim 15, wherein pushing the plurality of elongated, narrow-ended columns between the plurality of vertical slats of the crib, secures the fabric covering and the foam component onto the crib.

17. The method of claim 16, wherein the fabric covering and foam component are secured around the perimeter of the crib via a fastener strap having a hook and loop securing means.

* * * * *